US010168085B2

(12) United States Patent
Kent et al.

(10) Patent No.: US 10,168,085 B2
(45) Date of Patent: Jan. 1, 2019

(54) CONDENSER HAVING A REFRIGERANT RESERVOIR ASSEMBLY CONTAINING A DESICCANT BAG

(75) Inventors: Scott E. Kent, Albion, NY (US); Agnieszka Filipiak, Ostrow Wlkp (PL)

(73) Assignee: MAHLE International GmbH, Stuttgart (DE)

( * ) Notice: Subject to any disclaimer, the term of this patent is extended or adjusted under 35 U.S.C. 154(b) by 797 days.

(21) Appl. No.: 13/410,754

(22) Filed: Mar. 2, 2012

(65) Prior Publication Data

US 2012/0227946 A1 Sep. 13, 2012

Related U.S. Application Data

(60) Provisional application No. 61/450,703, filed on Mar. 9, 2011.

(51) Int. Cl.

| | |
|---|---|
| ***F25B 39/04*** | (2006.01) |
| ***F28F 9/02*** | (2006.01) |
| ***F25B 43/00*** | (2006.01) |

(52) U.S. Cl.

CPC ..... *F25B 39/04* (2013.01); *F25B 43/003* (2013.01); *F25B 2339/0441* (2013.01); *F25B 2500/01* (2013.01)

(58) Field of Classification Search

CPC ..... F25B 2339/0441; F25B 2500/01; F25B 39/04; F25B 43/003

USPC ..... 62/509; 165/173

See application file for complete search history.

(56) References Cited

U.S. PATENT DOCUMENTS

| | | | | |
|---|---|---|---|---|
| 1,590,266 | A * | 6/1926 | Tiedtke et al. | 96/145 |
| 3,313,718 | A * | 4/1967 | Bloch | 205/703 |
| 4,401,447 | A * | 8/1983 | Huber | B01D 53/0415 210/282 |
| 4,410,441 | A | 10/1983 | Davies et al. | |
| 4,589,892 | A * | 5/1986 | Leonard | 96/115 |
| 4,813,212 | A * | 3/1989 | Cullen et al. | 53/450 |
| 4,846,855 | A * | 7/1989 | Tsujimoto | 95/113 |
| 5,287,961 | A | 2/1994 | Herran | |
| 5,713,217 | A | 2/1998 | Baba | |
| 5,813,249 | A | 9/1998 | Matsuo et al. | |

(Continued)

FOREIGN PATENT DOCUMENTS

| | | |
|---|---|---|
| DE | 102 50 384 A1 | 5/2003 |
| EP | 0 414 463 A2 | 2/1991 |

(Continued)

OTHER PUBLICATIONS

Machine Translation of JP 2009-121782 to Ohashi, "Heat Exchanger", PAJ, p. 8 and FIG. 1-7.*

European Search Report dated Mar. 28, 2014.

*Primary Examiner* — Filip Zec

(74) *Attorney, Agent, or Firm* — Brinks Gilson & Lione

(57) ABSTRACT

A condenser having a receiver for use in an air conditioning system, having a plurality of refrigerant tubes, at least one header in hydraulic communication with the plurality of refrigerant tubes, and a receiver housing connected to the header. The receiver housing includes a refrigerant conduit nested within the spine of a desiccant bag. The spine divided the desiccant bag into two desiccant compartments, which are folded over the refrigerant conduit such that the desiccant compartments urge the refrigerant conduit onto the spine, thereby holding the desiccant bag in a predetermined position.

10 Claims, 4 Drawing Sheets

(56) References Cited

U.S. PATENT DOCUMENTS

| | | | | |
|---|---|---|---|---|
| 5,814,136 | A * | 9/1998 | Wood | B01D 53/0415 210/282 |
| 6,083,305 | A * | 7/2000 | LeConey | B01D 53/0415 210/282 |
| 6,170,288 | B1 * | 1/2001 | Incorvia | 62/509 |
| 6,178,772 | B1 * | 1/2001 | Incorvia | 62/509 |
| 6,267,173 | B1 | 7/2001 | Hu et al. | |
| 6,374,632 | B1 * | 4/2002 | Nobuta et al. | 62/509 |
| 6,397,627 | B1 | 6/2002 | Aki | |
| 6,427,480 | B1 | 8/2002 | Ito et al. | |
| 7,213,412 | B2 | 5/2007 | Kent et al. | |
| 7,836,725 | B2 | 11/2010 | Lautner et al. | |
| 2004/0031596 | A1 * | 2/2004 | Nishida | B60H 1/3227 165/140 |
| 2004/0081727 | A1 | 4/2004 | Kelly et al. | |
| 2005/0279125 | A1 | 12/2005 | Operschall | |

FOREIGN PATENT DOCUMENTS

| | | | |
|---|---|---|---|
| EP | 1 477 750 | A1 | 11/2004 |
| JP | 2009 121782 | A | 6/2009 |
| WO | 98/05906 | A1 | 2/1998 |
| WO | 00/50825 | A1 | 8/2000 |

* cited by examiner

CONDENSER HAVING A REFRIGERANT RESERVOIR ASSEMBLY CONTAINING A DESICCANT BAG

CROSS-REFERENCE TO RELATED APPLICATION

This application claims the benefit of U.S. Provisional Patent Application Ser. No. 61/450,703 for a REFRIGERANT RESERVOIR ASSEMBLY, filed on Mar. 9, 2011, which is hereby incorporated by reference in its entirety.

TECHNICAL FIELD OF INVENTION

The present disclosure relates to an air conditioning system; specifically, to a sub-cooled condenser having a receiver; and more specifically, to a receiver having a desiccant bag.

BACKGROUND OF INVENTION

Heat exchangers used to condense a high pressure vapor refrigerant into a high pressure liquid refrigerant for an air-conditioning system are known in the art and are referred to as condensers. Sub-cooled condensers typically include a plurality of tubes extending between an inlet/outlet header and a return header. The tubes are divided into an upstream group within which the refrigerant is condensed from a gas to a liquid, and a downstream, or "sub-cooling" group, within which the condensed refrigerant is further cooled prior to exiting the condenser. Both the inlet/outlet header and the return header typically include an internal partition that divides each of the headers into a first chamber and a second chamber. The first chambers are in hydraulic communication with the upstream group of tubes and the second chambers are in hydraulic communication with the sub-cooling group of tubes. The refrigerant enters the first chamber of the inlet/outlet header and flows through the upstream group of tubes into the first chamber of the return header. The refrigerant is then typically directed through a refrigerant reservoir assembly, also known as a receiver, having a desiccant material to remove any water before entering the second chamber of the return header to be directed through the sub-cooling group of tubes. After passing through the sub-cooling group of tubes, the refrigerant exits the condenser through the second chamber of the inlet/outlet header.

U.S. Pat. No. 7,213,412 discloses a condenser having an integral receiver that is substantially parallel to the return header and is hereby incorporated by reference in its entirety. The integral receiver includes a refrigerant conduit that extends between an entry end and a discharge end within the receiver. The refrigerant conduit is engaged to a receiver separator that divides the receiver into a first chamber and a second chamber, in which the entry end and discharge end of the refrigerant conduit extend into the first chamber and second chamber of the receiver, respectively. A first fluid port is provided between the first chamber of the return header and the first chamber of the receiver, and a second fluid port is provided between the second chamber of the return header and the second chamber of the receiver. The refrigerant flows into the first chamber of the receiver from the first chamber of the return tank through the first fluid port, continues through the refrigerant conduit to the second chamber of the receiver, and then exits the second fluid port into the second chamber of the return tank.

Permeable bags containing desiccants (desiccant bags) are known to be disposed in the receiver to remove water from the refrigerant flowing through the receiver. Current desiccant bags and bag enclosures are designed to accommodate a variety of reservoir shapes, including that of a cylindrical shape. The desiccant bags are typically fixed onto the refrigerant conduit and then inserted into the receiver through an opened end. However, the inserting of the refrigerant conduit with the attached desiccant bag causes the desiccant in the bag to bind up against the opening and internal wall of the receiver resulting in an uneven distribution of desiccant in the cavity of the receiver, thereby potentially impeding the flow of the refrigerant flow through the refrigerant conduit resulting in a higher pressure drop through the condenser. Furthermore, the binding of the desiccant creates undue efforts in the insertion of the desiccant into the receiver, increasing the potential of damaging the desiccant bag.

There is a long felt need to have a refrigerant reservoir assembly, in which the refrigerant conduit and desiccant bag may be assembled and inserted into the receiver housing without undue efforts or potentially damaging the desiccant bag.

SUMMARY OF THE INVENTION

In accordance with an embodiment of the invention is a condenser having a refrigerant reservoir assembly for use in an air conditioning system. The condenser having a refrigerant reservoir assembly includes a plurality of refrigerant tubes, at least one header in hydraulic communication with the plurality of refrigerant tubes, wherein the header includes a header partition separating the header into a first header chamber and a second header chamber, and a receiver housing connected to the header. The receiver housing includes a refrigerant conduit having a receiver partition separating the receiver housing into a first receiver chamber and a second receiver chamber, a first port for directing refrigerant from the first chamber of the header to the first chamber of the receiver housing, a second port for directing refrigerant from the second chamber of the receiver to the second chamber of the header, and a desiccant bag contained within the first chamber of the receiver. The desiccant bag includes a spine extending along an axis in the direction of the refrigerant conduit, thereby dividing the desiccant bag into two desiccant compartments.

The refrigerant conduit is nested against the spine of the desiccant bag and the two desiccant compartments are folded over the refrigerant conduit such that the desiccant compartments urge the refrigerant conduit onto the spine, thereby holding the desiccant bag in a predetermined position. The two desiccant compartments contain sufficient desiccant material to surround a portion of the refrigerant conduit and compressed against a portion of the interior surface of the receiver housing. The spine includes a width that is greater than 40 percent of the outer circumference of the refrigerant conduit.

The embodiment of the invention provides at least the advantages that the refrigerant conduit and desiccant bag may be assembled and inserted into the refrigerant housing without undue efforts, allowing a greater amount of desiccant to be disposed within the limited volume of the receiver housing, and maintaining the desiccant bag in a predetermined location. Further features and advantages of the invention will appear more clearly on a reading of the following detailed description of an embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
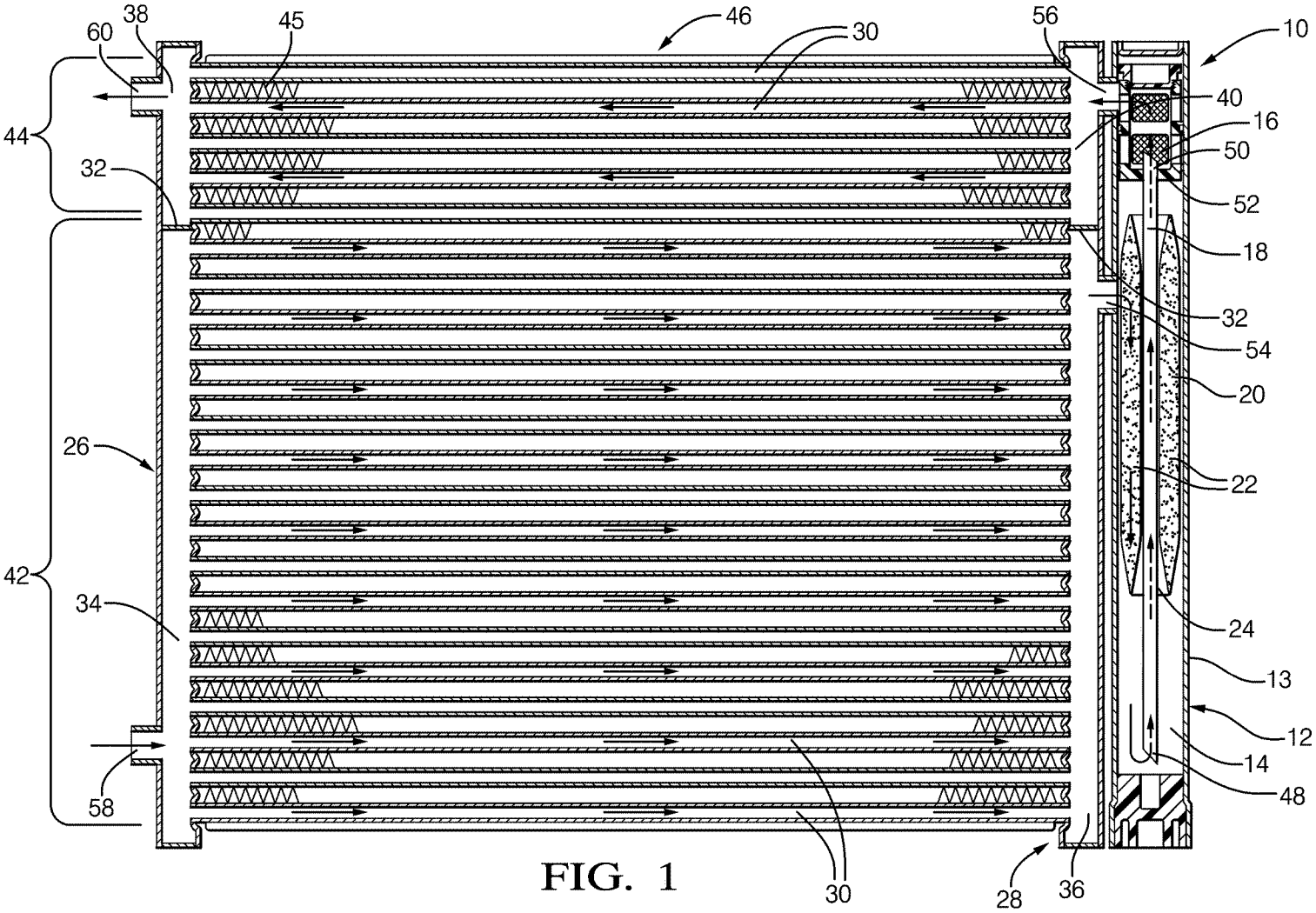
FIG. 1 shows a cross-sectional view of a condenser having a receiver with a desiccant bag disposed between the exterior surface of the refrigerant conduit and the interior surface of the receiver.

Referring now to the FIGS. 1 through 6, wherein like numerals indicate like or corresponding parts throughout the several views, is a condenser 10 for an air conditioning system. The condenser 10 includes a refrigerant reservoir assembly 12, also known as a receiver 12, having a receiver housing 13 defining a first receiver chamber 14 and a second receiver chamber 16, and a refrigerant conduit 18 within the receiver housing 13 for conveying a refrigerant from the first receiver chamber 14 to the second receiver chamber 16. The refrigerant conduit 18 is nested within an improved desiccant bag 20 that includes a spine 24 dividing the desiccant bag 20 into two desiccant compartments 22. The spine 24 has a shape and dimension, which will be detailed below, that allows the desiccant bag 20 to be folded easily round the refrigerant conduit 18 such that with the spine 24 cooperates with the desiccant compartments 22 to grip the refrigerant conduit 18, thereby properly positioning and maintaining the desiccant bag 20 within the receiver housing 13.

Shown in FIG. 1 is a condenser 10 having an inlet/outlet header 26, a return header 28 spaced from the inlet/outlet header 26, a plurality of tubes 30 extending between and in hydraulic communication with the inlet/outlet header 26 and return header 28, and a receiver 12 integral with the return header 28. Both the inlet/outlet header 26 and return header 28 include a header partition 32 that divides each of the headers 26, 28 into corresponding first chambers 34, 36 and second chambers 38, 40. The plurality of tubes 30 includes a first group of tubes 42 and a second group of tubes 44, in which the first group of tubes 42 is in hydraulic communication with the inlet/out header first chamber 34 and the return tank first chamber 36, and the second group of tubes is in hydraulic communication with the inlet/out header second chamber 38 and the return tank second chamber 40. The first group of tubes 42 defines a refrigerant condensing section and the second group of tubes 44 defines a sub-cooling section. A plurality of corrugated fins 45 is interposed between the tubes 30. The condensing section and sub-cooling section, together with the corrugated fins, define the condenser core 46.

The integral receiver 12 is adjacently parallel to the return header 28 and includes a receiver housing 13 containing a refrigerant conduit 18 that extends between an entry end 48 and a discharge end 50 within the receiver housing 13. The refrigerant conduit 18 may include a receiver separator 52 that divides the receiver housing 13 into a receiver first chamber 14 and a receiver second chamber 16. The refrigerant conduit entry end 48 and refrigerant conduit discharge end 50 extend into the receiver first chamber 14 and receiver second chamber 16, respectively. A first fluid port 54 is provided between the return header first chamber 36 and the receiver first chamber 14 for refrigerant flow therebetween, and a second fluid port 56 is provided between the return header second chamber 40 and the receiver second chamber 16 for refrigerant flow therebetween.

The inlet/outlet header 26 includes an inlet opening 58 and an outlet opening 60 in hydraulic communication with the first and second chambers 34, 38 of the inlet/outlet header 26, respectively. Typically, a high pressure vapor refrigerant enters the inlet/out header first chamber 34 via the inlet opening 58 and flows through the first group of tubes 42 to the return tank first chamber 36. As the refrigerant flows through the first group of tubes 42, heat energy is released to the ambient air and the high pressure vapor refrigerant is condensed to a high pressure liquid refrigerant. The liquid refrigerant then flows from the return tank first chamber 36 through the first fluid port 54 into the receiver first chamber 14. The liquid refrigerant flows through a desiccant bag 20, which is a refrigerant permeable bag containing a desiccant material, toward the entry end 48 of the refrigerant conduit 18. Any water in the liquid refrigerant is absorbed in the desiccant material. The refrigerant then flows through the refrigerant conduit 18 discharging into the receiver second chamber 16. The refrigerant then exits the receiver second chamber through the second fluid port 56 into the return header second chamber 40 before flowing down the second group 44 of tubes to the inlet/outlet tank second chamber 38 and then exits the outlet opening 60.

Figure 2:
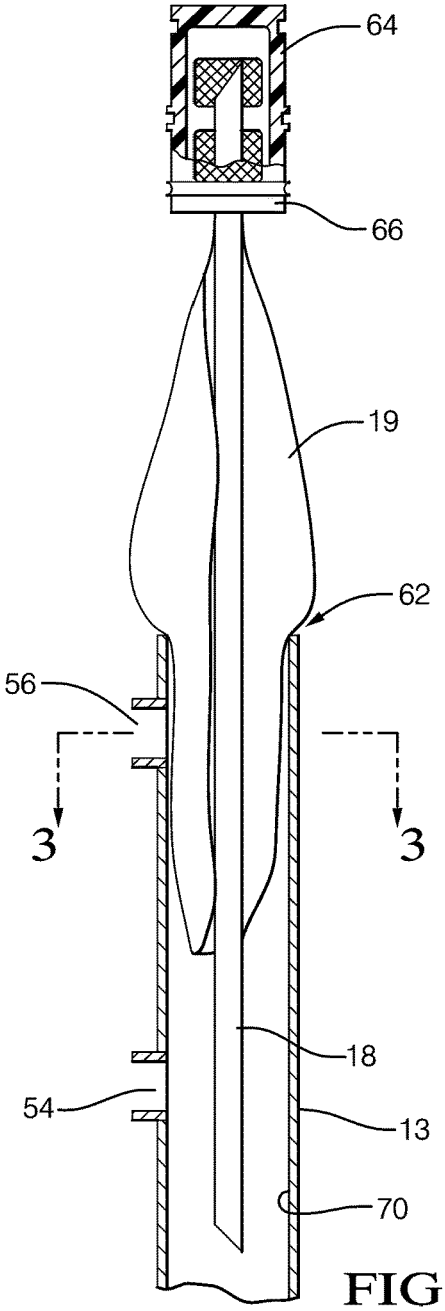
FIG. 2 shows a partial cross-sectional view of the receiver portion of a condenser as a prior art desiccant bag is inserted into an open end of the receiver.
Figure 4:
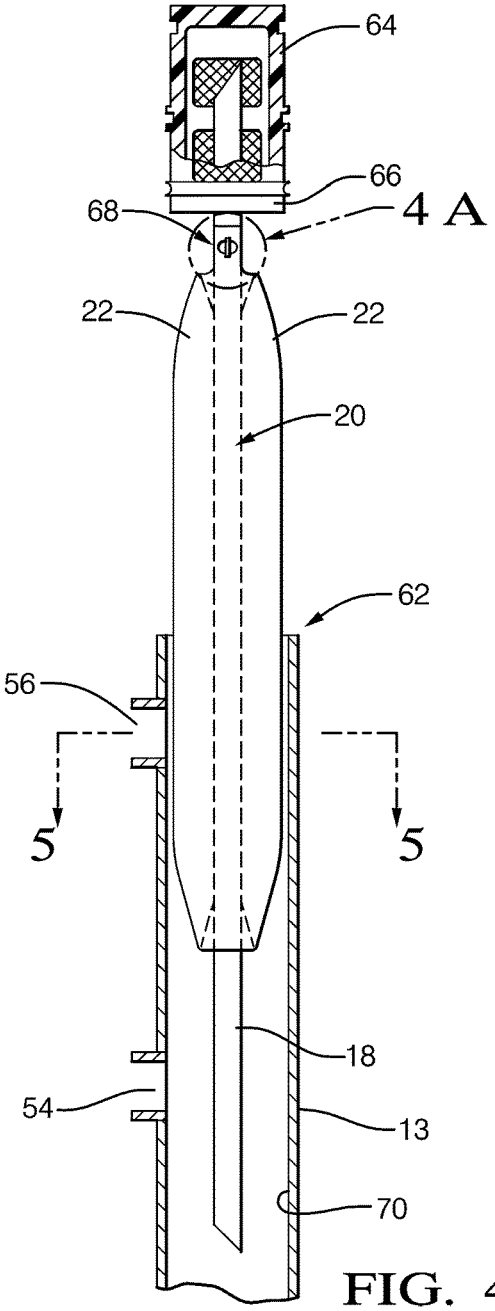
FIG. 4 shows a refrigerant conduit and desiccant bag having at least two compartments and a center spine therebetween in accordance with an embodiment of the invention, wherein the refrigerant conduit is nested on the spine, being inserted into an end of the receiver.
Figure 4A:
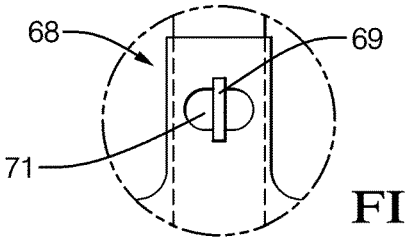
FIG. 4*a* is a detail view of an end of the desiccant bag having a rectangular aperture fitted over a rectangular key.

Referring to FIGS. 2 and 4, for ease of assembly, the receiver housing 13 includes an open end 62 through which the refrigerant conduit 18 and desiccant bag is inserted. After assembly, the open end 62 may be hermetically sealed with a threaded end cap (not shown) or by any other known methods in the art such as welding, brazing, or epoxying for attaching an end cap onto a header. The refrigerant conduit 18 may include a filter element 64 and a receiver partition 66, in which the receiver partition 66 may be separate from or integral part of the filter element 64. The receiver partition 66 engages the interior wall 70 of the receiver housing 13 thereby separating the receiver housing 13 into the first and second receiver chambers 14, 16 as shown in FIG. 1. The filter element 64, receiver partition 66, or the refrigerant conduit 18 may include a hook mechanism 68 that is configured to secure onto an end of the desiccant bag 20. Shown in FIG. 4A, the hook mechanism 68 may be a protrusion extending radially from the refrigerant conduit assembly and includes a rectangular key 69 that extends in the direction of the refrigerant conduit 18. An end of the desiccant bag 20 may define a rectangular aperture 71 that is substantially perpendicular to the refrigerant conduit 18 once assembled. The rectangular key 69 is aligned with and inserted into the rectangular aperture 71 during assembly.

After assembly, the desiccant bag is rotated parallel to the refrigerant conduit to lock the desiccant bag 20 onto the refrigerant conduit 18.

Figure 3:
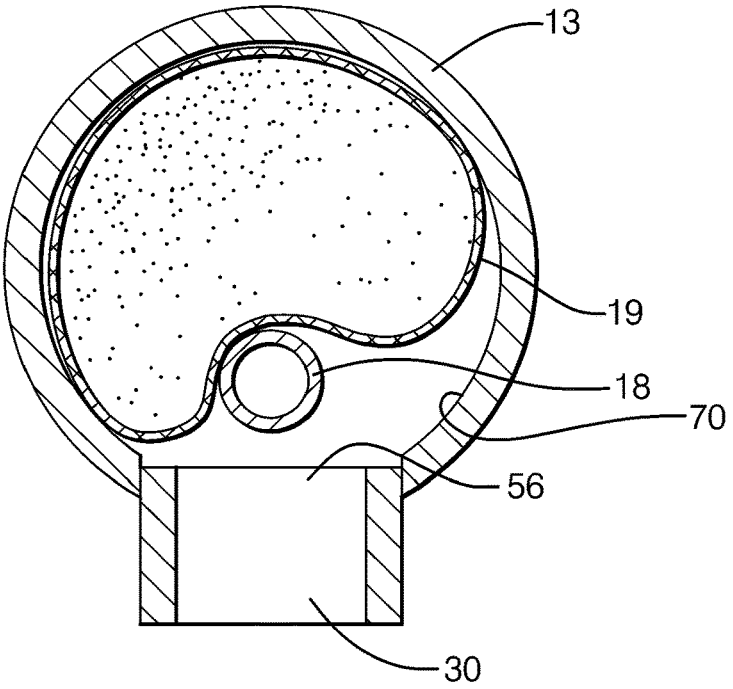
FIG. 3 is a cross-sectional view of the receiver portion of FIG. 2 along line 3-3.

FIG. 2 shows a prior art desiccant bag 19 attached to the refrigerant conduit 18 as the conduit/bag assembly is being inserted into the open end 62 of the receiver housing 13. The prior art desiccant bag 19 is typically that of a single compartment elongated refrigerant permeable bag in which is packed with a granular desiccant material that is known in the art. As the conduit/bag assembly is inserted into the open end 62, the granular desiccant material shifts within the bag causing the desiccant bag 19 to bunch around the open end 62 and bind up against the interior wall 70 of the receiver housing 13, thereby resulting in an uneven distribution of the desiccant within the receiver housing 13. Shown in FIG. 3 is a cross-section of the receiver housing 13 shown in FIG. 2 along section line 3-3. The refrigerant conduit 18 is shown positioned adjacent to the second fluid port 56. The unevenly distributed granular desiccant material within the desiccant bag 19 creates areas with densely packed desiccant material that may impede refrigerant flow in the receiver housing 13.

Figure 5:
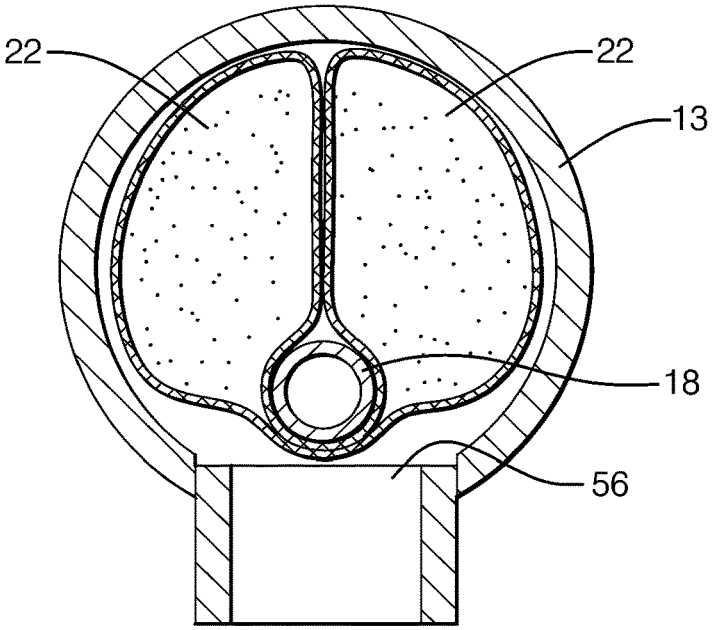
FIG. 5 is a cross-sectional view of the receiver of FIG. 4 along line 5-5.

Shown in FIG. 4 is refrigerant reservoir assembly 12 having an improved desiccant bag 20 that includes a spine 24 that divides the desiccant bag 20 into two separate desiccant compartments 22. The refrigerant conduit 18 is shown nested against the spine 24 of the improved desiccant bag 20 as the conduit/bag assembly is being inserted into the open end 62 of the receiver housing 13. The desiccant bag 20 is folded over the refrigerant conduit 18 such that the spine 24 cooperates with the desiccant compartments 22 to properly position and maintain the desiccant bag 20 onto the refrigerant conduit 18. Shown in FIG. 5 is cross-section of the receiver housing 13 shown in FIG. 4 along section line 5-5. The refrigerant conduit 18 is shown adjacent to the second fluid port 56 and both of the compartments 22 of the desiccant bag 20 contain sufficient desiccant material to substantially occupy the cross-sectional volume of the receiver housing 13 without substantial bunching or binding.

Figure 6:
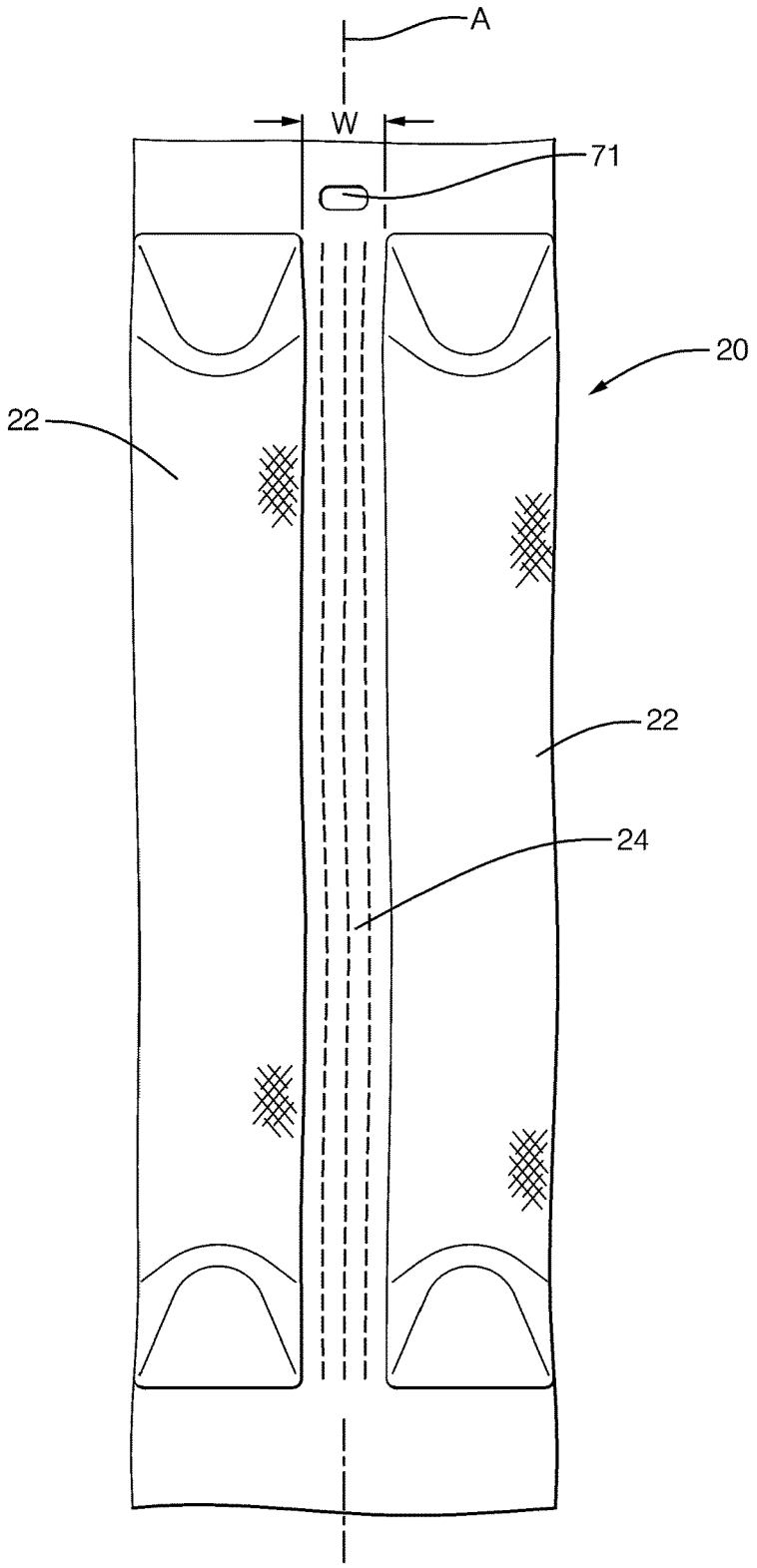
FIG. 6 shows a desiccant bag having at least two compartments and a center spine therebetween, wherein the spine has a predetermined width allowing the refrigerant conduit to be nested between the two compartments.

Shown in FIG. 6 is the improved desiccant bag 20 in an unfolded state extending along an axis A. The desiccant bag is formed of a refrigerant permeable material that is known in the art and filled with a desiccant material that is also known in the art. The desiccant bag 20 includes a spine 24 that extends along the axis A dividing the desiccant bag into two compartments 22, one on either side of the spine 24. The spine 24 includes a predetermined width (W) such that once the desiccant compartments 22 are folded over the tube, the spine 24 cooperate with the desiccant compartments 22 to securely grip against the refrigerant conduit 18 during the insertion of the conduit/bag assembly into the open end 62 of the receiver housing 13 during assembly. It was found that if the width (W) of the spine 24 is between 40 to 80 percent of the outer circumference of the refrigerant conduit 18, the desiccant bag 20 will fold in a precise manner to securely grip the refrigerant conduit. A spine having a width between 60 to 80 percent, preferably 70 to 75 percent, of the outer circumference of the refrigerant conduit 18 provides a secure grip over a wide range of pack density of the desiccant within the desiccant bag 20.

The embodiment of the invention provides an advantage that the refrigerant conduit and desiccant bag may be assembled and inserted into the refrigerant housing without undue efforts. Another advantage is that a greater amount of desiccant may be disposed within the limited volume of the receiver housing. Still, another advantage is that the desiccant may be maintained in a predetermined location. Yet, another advantage is that the refrigerant conduit may be also maintained in a predetermined location within the receiver housing.

While this invention has been described in terms of the preferred embodiments thereof, it is not intended to be so limited, but rather only to the extent set forth in the claims that follow.

Having described the invention, it is claimed:

1. A condenser having a receiver for use in an air conditioning system, comprising:

a plurality of refrigerant tubes;

a header in hydraulic communication with said plurality of refrigerant tubes, wherein said header includes a header partition separating said header into a first header chamber and a second header chamber; and a receiver housing hydraulically connected to said header, wherein said receiver housing includes a refrigerant conduit extending vertically along the receiver housing having a receiver partition separating said receiver housing into a first receiver chamber and a second receiver chamber, a first port for directing refrigerant from said first header chamber to said first receiver chamber, a second port for directing refrigerant from said second receiver chamber to said second header chamber, and a desiccant bag contained within said first chamber of said receiver, wherein the refrigerant conduit is disposed closer to the second port than to a wall of the receiver housing opposite the second port, wherein said desiccant bag includes a spine extending along an axis in the direction of said refrigerant conduit, thereby dividing said desiccant bag into two desiccant compartments, wherein the second port is located on a first radial side of the spine and the refrigerant conduit is disposed on a second radial side of the spine opposite the first radial side, wherein the desiccant bag surrounds the refrigerant conduit, with the spine surrounding a first partial circumference of the refrigerant conduit proximate the second port and each of the two desiccant compartments surrounding a respective further partial circumference of the refrigerant conduit adjacent to the first partial circumference and remote from the second port, the refrigerant conduit extending along the spine and beyond the spine, above and below the spine;

wherein said spine is configured to cooperate with said two desiccant compartments to maintain said refrigerant conduit in a predetermined position within said receiver housing.

2. The condenser having a receiver of claim 1, wherein a portion of said refrigerant conduit is nested against said spine of said desiccant bag.

3. The condenser having a receiver of claim 2, wherein said two desiccant compartments are folded over said refrigerant conduit such that said desiccant compartments urge said refrigerant conduit onto said spine, thereby maintaining said desiccant bag in a predetermined position.

4. The condenser having a receiver of claim 3, wherein said two desiccant compartments contain sufficient desiccant material to surround said portion of said refrigerant conduit and press against a portion of the interior surface of said receiver housing.

5. The condenser having a of claim 2, wherein said desiccant bag includes a length and a width, in which the length is greater than the width, and said spine bisects said desiccant bag lengthwise into said two desiccant compartments.

6. The condenser having a receiver of claim 5, wherein said spine includes a width that is greater than 40 percent of the outer circumference of the refrigerant conduit.

7. The condenser having a receiver of claim 5, wherein said spine includes a width that is between 60 to 80 percent of the outer circumference of the refrigerant conduit.

8. The condenser having a receiver of claim 5, wherein said spine includes a width that is between 70 to 75 percent of the outer circumference of the refrigerant conduit.

9. The condenser having a receiver of claim 5, wherein at least one end of said spine defines an aperture configured to accept a hook mechanism extending from said refrigerant conduit located within said receiver.

10. The condenser having a receiver of claim 9, wherein said hook mechanism includes a rectangular key extending in the direction of said refrigerant conduit, and wherein said aperture includes a rectangular shape extending in a direction substantially perpendicular to said spine.

* * * * *